United States Patent [19]

Stipanuk et al.

[11] Patent Number: 4,577,922

[45] Date of Patent: Mar. 25, 1986

[54] LAMINATED ELECTRICAL CONNECTOR ARRANGEMENT

[75] Inventors: John M. Stipanuk, Glen Ellyn; Alan S. Walse, LaGrange; Kent E. Regnier, Lombard, all of Ill.

[73] Assignee: Molex Incorporated, Lisle, Ill.

[21] Appl. No.: 719,944

[22] Filed: Apr. 4, 1985

[51] Int. Cl.[4] ..... H01R 13/50; H01R 3/00

[52] U.S. Cl. ..... 339/176 MP; 339/17 C; 339/278 D

[58] Field of Search ..... 339/59 R, 59 M, 278 D, 339/DIG. 3, 17 C, 176 M, 176 MF, 176 MP, 258 R, 258 P, 17 LM, 17 M

[56] References Cited

U.S. PATENT DOCUMENTS 3,764,955 10/1973 Ward ..... 339/17 C
4,169,646 10/1979 Stape et al. ..... 339/99 R
4,245,876 1/1981 Ritchie et al. ..... 339/59 M

*Primary Examiner*—Gil Weidenfeld
*Assistant Examiner*—Gary F. Paumen
*Attorney, Agent, or Firm*—Louis A. Hecht; Bruce R. Mansfield

[57] ABSTRACT

Disclosed is a laminated multiconductor connector having a plurality of free standing metal terminals with oppositely facing nested surfaces and circuit board tails for electrically engaging the printed circuit board. Dielectric material is disposed between adjacent nesting surfaces of the terminal body in such a manner so as to insulate the nesting surfaces of adjacent terminals and to form a continuous mutually supported stacked array of terminals when mounted to the printed circuit board.

Also disclosed is an intermediate subassembly and a related method of production the multiconductor connector.

8 Claims, 7 Drawing Figures

LAMINATED ELECTRICAL CONNECTOR ARRANGEMENT

BACKGROUND OF THE INVENTION

1. Field of the Invention

The present invention pertains to multi-circuit electrical connector arrangements which are mounted to a printed circuit board or the like.

2. Description of the Prior Art

Multi-circuit electrical connectors of the type adapted for mounting on a printed circuit board typically include a plurality of electrical terminals disposed within a unitary dielectric housing. Such housings typically totally surround portions of the terminals immediately adjacent the printed circuit board to provide rigid support therefor. Difficulties in maintaining the pitch or centerline spacing of terminals has been encountered with increasing connector miniaturization. Difficulties in pitch control arise because of the inherent physical properties of the dielectric material of which the housings are made. For example, it is well known that many plastics tend to swell somewhat with increasing humidity. These and other like processes tend to deteriorate the dimensional tolerance of connector housings. Nonetheless, there is an increasing need to reduce the pitch or centerline spacing of electrical connector terminals.

SUMMARY OF THE INVENTION

Accordingly, it is an object of the present invention to provide a multi-circuit electrical connector assembly which provides greater pitch control in connectors of greatly reduced size.

Another object of the present invention is to provide a multicircuit electrical connector which does not require a dielectric housing to support the terminals thereof, with terminal pitch control remaining unaffected by housing dimensional tolerances.

Yet another object of the present invention is to provide a multi-circuit electrical connector arrangement in which the interelement capacitance between adjacent terminals is vigorously controlled in a simple inexpensive arrangement.

These and other objects of the present invention are provided in an electrical connector arrangement for mounting to a printed circuit board comprising:

a plurality of generally side-by-side free standing metal terminals mounted to said board, each terminal having a body with oppositely facing nesting surfaces, a depending circuit board tail for electrical engagement with said board and means to mate with another electrical member; and dielectric means being disposed between said terminal bodies in such a manner to insulate the nesting surfaces of adjacent terminals and to form a continuous mutually supported stacked array of terminals when mounted to a printed circuit board.

BRIEF DESCRIPTION OF THE DRAWINGS

In the drawings, wherein like elements are referenced alike.

DETAILED DESCRIPTION OF THE PREFERRED EMBODIMENT

The laminated connector arrangement of the present invention represents a significant advance over close-pitch prior art connectors, wherein a dielectric housing for supporting and spacing the connector terminals is no longer required. According to the present invention, various conventional dielectric coating arrangements which can be accurately controlled in their thickness are employed to provide a very accurate control over the connector pitch, or centerline spacing between terminals. Swelling and shrinking of the inter-terminal insulation of plastic housings due to modest changes in humidity and temperature is avoided. Further, by a judicious choice of dielectric materials, the laminated connector arrangement of the present invention can have well-defined inter-terminal electrical capacitance properties. The choice of dielectric coating, and coating thickness between adjacent terminals provides an accurate definition of electrical capacitance between those terminals—a feature which is particularly important in filtered connector applications.

Figure 1:
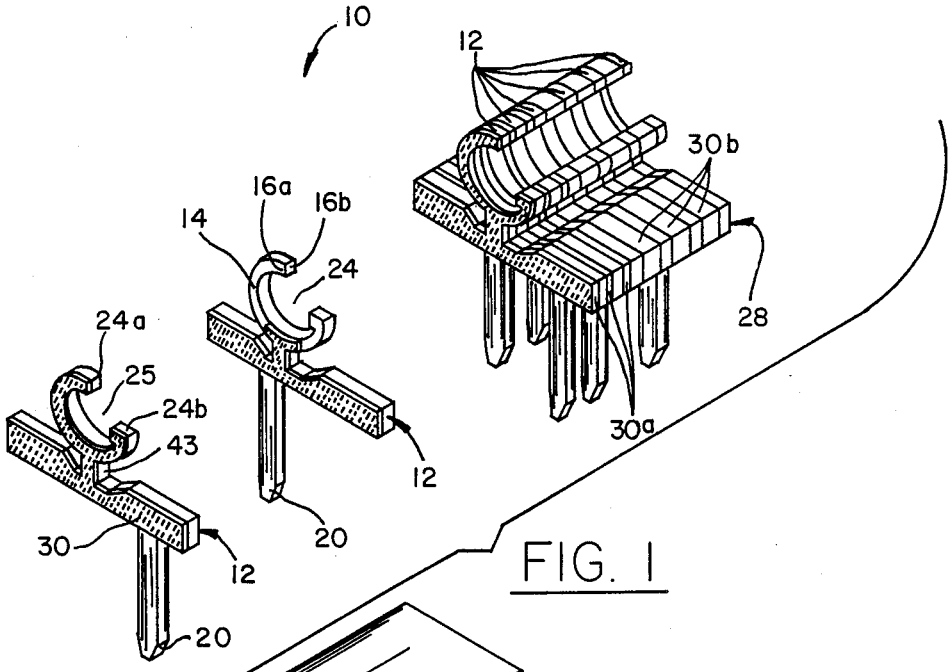
FIG. 1 is an exploded view of a laminated connector of the present invention.

Referring now to the drawings, and in particular to FIG. 1, an exploded view of a connector assembly 10 according to the present invention is shown. Assembly 10 comprises a plurality of generally side-by-side free standing metal terminals 12 which are adapted for mounting in a printed circuit board, such as that shown in FIG. 2. Terminals 12 have a body 14 with oppositely facing nesting surfaces 16*a*, 16*b* and a depending circuit board tail portion 20 for electrical engagement with a printed circuit board. As indicated in FIG. 1, the circuit board tails 20, adapted for through-hole mounting, can be staggered to prevent weakening of the printed circuit board in close pitch arrangements. Although the tail portion 20 shown in FIG. 1 is of the solder tail type, adapted to be received in a through-hole of a printed circuit board, the tail portion could as well be adapted for surface mounting to a printed circuit board. (see FIG. 3).

Terminals 12 also include a socket-type mating means 24 adapted for mating with another electrical member, such as an edge of a printed circuit card. As shown in the right hand portion of FIG. 1, a plurality of terminals 12 are arranged to form a continuous mutually supported stacked array 28. Adjacent nesting surfaces of adjacent terminals are in intimate physical engagement with each other, so that the support of any individual terminal can be shared with adjacent terminals. The overall supporting effect for the stacked array 28 is considerably greater than the support for an individual terminal 12.

To prevent electrical contact or shorting between adjacent terminals 12, at least one of the nesting surfaces of a pair of adjacent terminals is provided with a dielectric covering means 30 to provide insulation between the nesting surfaces of adjacent terminals in a stacked array 28. The dielectric means 30 may take various forms as a terminal coating, such as a heat bonded coating, a coating which is sprayed or rolled on the conductive terminal, or a coating of thermosetting material.

Alternatively, coating 30 may comprise a dielectric laminate which has applied to the metallic terminal with a pressure sensitive adhesive. The term "dielectric coating" as used herein refers to all such dielectric surface treatments.

In each instance, it is preferred that the coating 30 be applied to a metal blank prior to any punching or forming of the blank to produce a terminal 12. However, it might be advantageous in a particular instance to apply the dielectric coating to a terminal after it is stamped or otherwised formed. Dielectric means 30 may also comprise a free standing sheet of dielectric material which does not adhere to a nesting surface of a terminal, but rather is positioned between the nesting surfaces of adjacent terminals so as to be associated therewith when a stacked array 28 of loose terminals is mounted in a printed circuit board.

As an aid to assembly, the dielectric coating 30 applied to terminals 12 can be of a type having adhesive properties for joining adjacent terminals. In this embodiment, a stacked array 28, even prior to mounting on a printed circuit board, comprises a unitary free standing rigid unit which can be conveniently packaged and positioned using automated techniques. In any event, according to the present invention, the stacked array (even if comprised of loose unjoined terminals) will become a unitary rigid assembly when mounted to a printed circuit board.

Figure 2:
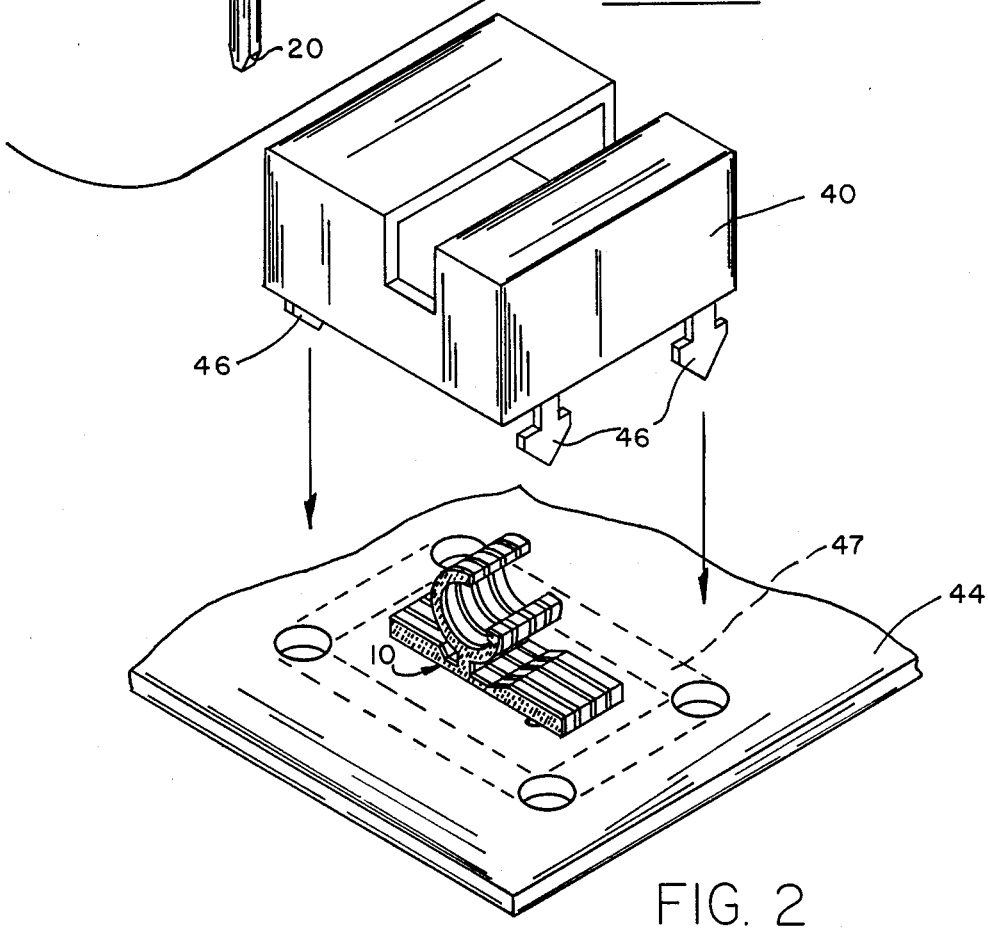
FIG. 2 shows a connector assembly mounted in a printed circuit board, with a cover surrounding the connector.

Turning now to FIG. 2, a cover 40 may be employed to surround connector assembly 10 subsequent to its mounting on a printed circuit board 44. Cover 40 is preferably directly attached to printed circuit board 44 using through-hole projecting latches 46 or other conventional mounting arrangements as is known in the art. Cover 40 provides protection against inadvertant damage to connector assembly 10 during assembly of an electronic instrument, and can also provide a strain relief or physical support for a mating connector which engages connector assembly 10. As such, in the present invention, cover 40 does not provide support for connector assembly 10 itself, but only to the connector which mates with assembly 10. The "footprint" of cover 40, showing its point of contact with printed circuit board 44 is shown by phantom lines 47.

Figure 3:
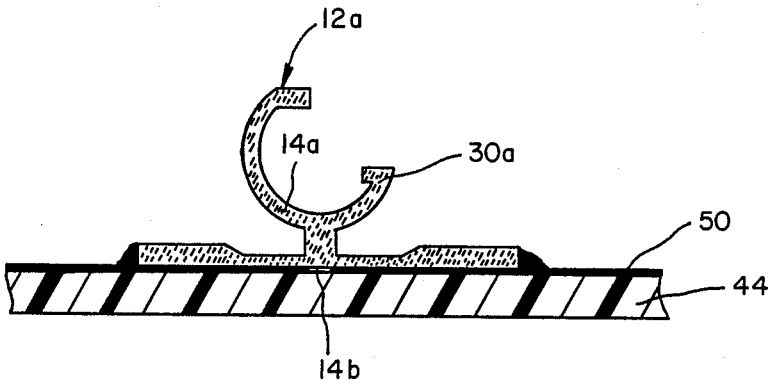
FIG. 3 shows a connector arrangement similar to that of FIG. 2, but adapted for surface mounting to a printed circuit board.

FIG. 3 shows an alternative embodiment of the arrangement of FIG. 2, wherein the connector terminals are mounted to printed circuit board 44 using surface mounting techniques, rather than the through-hole mounting techniques of FIG. 2. The bottom board engaging surface **14*b* of terminal body 14*a* comprises a board mounting tail which is soldered directed to printed circuit board contact pads 50 using surface mounting techniques as are known in the art. In this embodiment, it is convenient to provide a dielectric coating 30*a* having higher temperature characteristics to withstand the conventional reflor or the like mounting techniques. If a cover is applied to board 44 prior to reflow, adequate venting must be employed between the cover and printed circuit board 44** to facilitate the reflow process and to allow the withdrawal of any unwanted solder or flux enclosed by the cover.

Figure 4:
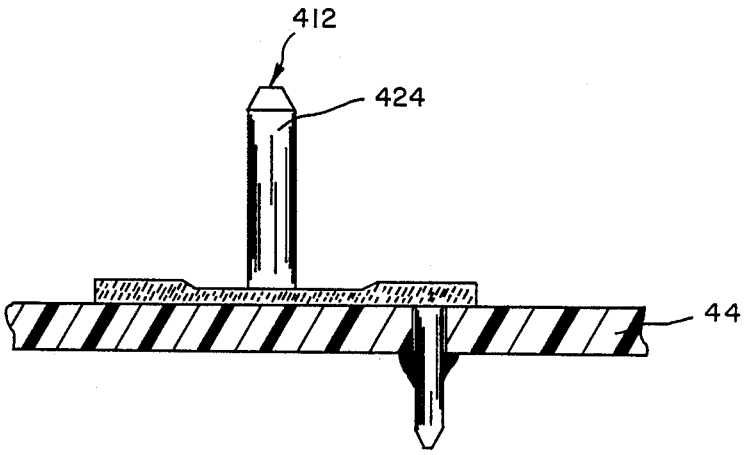
FIGS. 4 and 5 show alternative embodiments of the connector assembly according to the present invention.

FIG. 4 is an alternative arrangement of the present invention, substantially identical to that shown above in FIGS. 1 and 2, but with a different pin-like mating portion 424. which is adapted to engage a female-type mating terminal. Other features of the connector assembly are otherwise identical to that described above.

Figure 5:
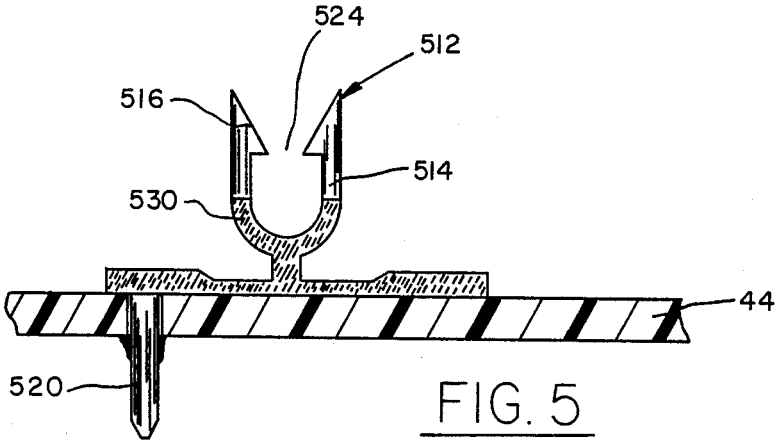

Turning now to FIG. 5, another connector arrangement 510 of the present invention is shown having a tuning fork type mating portion 524. Other features of the connector assembly 510 are substantially identical to that described above, wherein a stacked array of terminals 512 is formed with each terminal having a body portion 514 and oppositely facing nesting surfaces 516 and a depending tail portion 520 for either through-hole or surface mount engagement with the printed circuit board. Dielectric coating 530 is disposed between the terminal bodies 514 to form a continuous mutually supported stacked array of terminals when mounted to printed circuit board 44.

Figure 6:
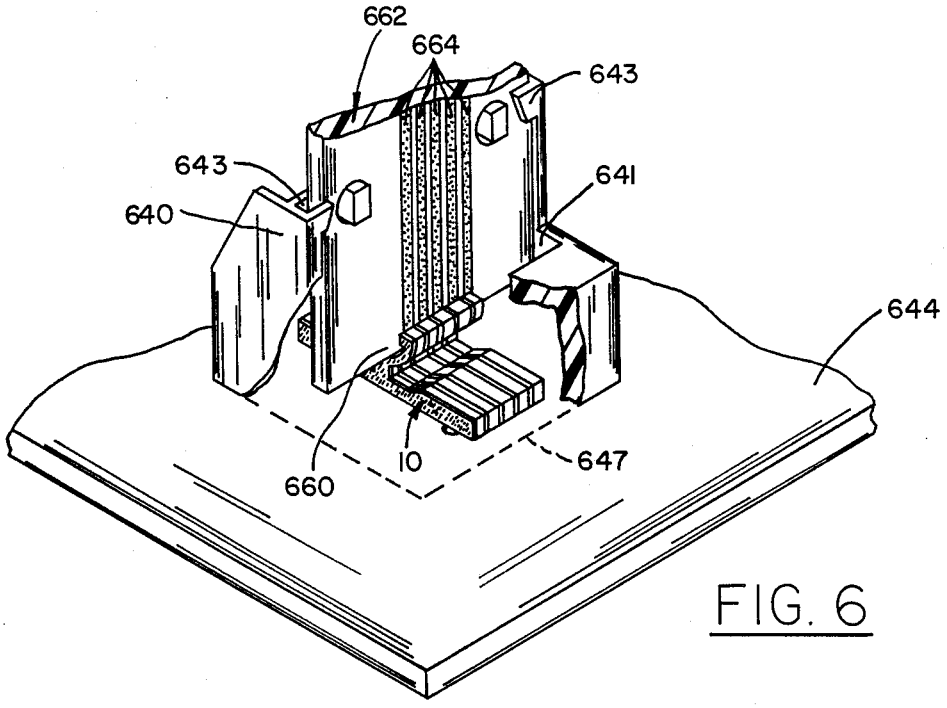
FIG. 6 shows an edge card connector assembly according to the present invention, with an associated surrounding cover.

FIG. 6 shows a connector assembly 10 identical to that shown in FIG. 1, in combination with a cover 640 to provide electrical engagement with an edge 660 of a printed circuit card 662. An example of a prior art arrangement of this type is shown and described in United States Patent Application Ser. No. 597,333 filed Apr. 6, 1984 and assigned to the assignee of the present invention. In this embodiment of the present invention, a low insertion force multiple contact connector 10 electrically engages a plurality of conductive pads or strips 664 formed along the insertable edge 660 of printed circuit card 662.

Referring to FIGS. 1 and 6, connector assembly 10 includes a plurality of connector spring contacts or mating portions 24 each comprising opposed deflectable contacting portions **24*a* for engaging the conductive strips 664 disposed on opposite sides of the insertable edge 660 of printed circuit card 662. The opposed contacting portions define an opening 25 through which the edge of the printed circuit card may be inserted through a slot 641 of cover 640 with a low or zero insertion force. Subsequently, the printed circuit card is pivoted or rotated through an angle into the final contacting position (shown in FIG. 6) wherein the mating portions 24 are deflected about their wrist-like mounting means 43. Cover 640 includes a pair of opposed resilient hook portions 643 which engage the printed circuit card lateral edges providing a strain relief for the inserted card 662**.

As with other covers that may be employed with the present invention, cover 640 merely surrounds the connector assembly 10, and does not employ depending projections or wall portions which are inserted between adjacent terminals 12. Phantom line 647 indicate the "footprint" of cover 640 on printed circuit board 644. Thus, it should be understood that the connector assembly 10 is entirely self supporting and free standing when installed in the printed circuit board.

Figure 7:
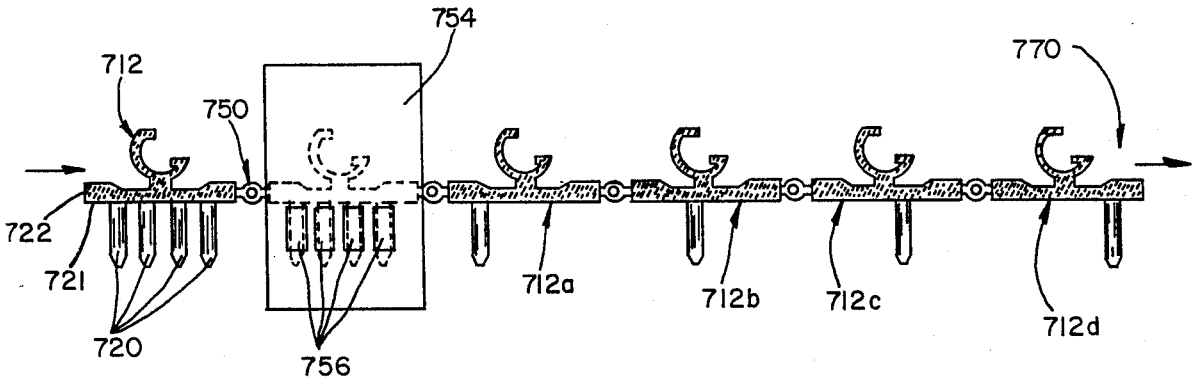
FIG. 7 shows a technique for manufacturing any terminal of the foregoing Figures.

Referring now to FIG. 7, a carrier assembly 770 is shown comprising a serial succession of terminals 712 stamped from an integral metal blank having at least one surface coated with a dielectric medium as explained above. Disposed between terminals 712, are carrier portions 750 which can be seperated from adjacent terminals using slitting machines as is well known in the art. Each terminal 712 is provided with a plurality of depending circuit board tail portions 720. A continuous carrier member could be employed to join all tail portions 720 together. In the embodiment shown in FIG. 7, each terminal is provided with four tail portions, each corresponding to a particular circuit tail position of a staggered mounting arrangement. Thus, in preparation for engagement with a printed circuit board, three of the four tail portions 720 of a given terminal are removed by a programmable 756 severing station 754 having four different severing blades 766 as shown in diagrammatic form in FIG. 7. Thus, by programming the actuation of severing blades 756, any desired tail portion 720 of a terminal can be selectively removed at station 754. As indicated in the right hand portion of FIG. 7, four consecutive terminals 712 have been provided with four different circuit tail positions. These four terminals (712*a*–712*d*) would be employed in a staggering mounting arrangement on a printed circuit board, wherein a circuit tail portion could occupy any one of four tail-receiving mounting positions in a circuit board to achieve a predetermined staggered effect. If desired, station 754 can be programmed to leave only a single predetermined tail position on the terminals which it processes. Or, as is more convenient for fully automated assembly, station 754 can be programmed to provide a sequence of terminals having successive mounting tail positions in groups forming a full set of mounting positions. Thus, in the example indicated in FIG. 7, a circuit tail portion 720 can occupy any one of four positions on a printed circuit board. A complete group of these positions would occur in four consecutive terminals 712*a*–712*d* prepared by station 754. The sequence of four would then repeat in a following group. Thus, terminal insertion equipment could remove each terminal sequentially to automatically provide the desired staggered pattern in a group of terminals associated together in a connector arrangement. Other staggered variations will become apparent to those skilled in the art.

As can be seen in FIG. 7, terminal 712 has a board engaging surface 721 and an end wall 722. The depending circuit board tails 720 all extend in the same general downward direction, at right angles the board engaging edge 721. In each terminal 712, the plurality of depending circuit board tails 720 appears at identical positions relative the board engaging edge 721 and the end wall 722. Further, each of the mounting positions of terminals 712*a*–712*d* occur at predetermined distances along board engaging edge 721 as measured from end wall 722. Thus, the programmable severing station 754 is easily programmed given the reference surface of board engaging edge 721 and the distances of the board mounting positions as measured from end wall 722. Alternatively the carrier subassembly 770 can be stored on reels for later shipment to a customer who would then employ a severing station to remove all but the desired terminals. Of course, if greater mounting regidity is required, each terminal can be left with two or more depending circuit tail portions. Such terminals could also be employed in shunting arrangements wherein a single terminal would be simultaneously connected at two different mounting positions of a printed circuit board.

As will be appreciated by those skilled in the art, the pitch of the laminated connector of the present invention can cover a broad range of terminal centerline spacings. The present invention, however, is particularly advantageous when employed to provide connector terminal pitches ranging between 0.010 and 0.050 inches, wherein terminal thicknesses range between 0.005 and 0.025 inches, and the interterminal dielectric means has thicknesses ranging between 0.005 and 0.025 inches.

We claim:

1. An electrical connector arrangement for mounting to a printed circuit board comprising:

a plurality of generally side-by-side free standing metal terminals adapted to be mounted to said board, each terminal having a body with oppositely facing nesting surfaces, a depending circuit board tail for electrical engagement with said board and means to mate with another electrical member; and dielectric means being disposed between said terminal bodies in such a manner to insulate the nesting surfaces of adjacent terminals and to form a continuous mutually supported stacked array of terminals when mounted to a printed circuit board.

2. The arrangement of claim 1 wherein said dielectric means includes a coating formed on at least one of the nesting surfaces of each terminal.

3. The arrangement of claim 2 wherein said dielectric means joins adjacent terminals together to form a rigid free standing assembly prior to engagement with said board.

4. The arrangement of claim 2 wherein said terminals are stamped from a flat metallic blank having said coating formed on at least one surface thereof.

5. The arrangement of claim 1 further including a dielectric covering surrounding said stacked array, said cover including means for securement to said printed circuit board.

6. The arrangement of claim 5 wherein said mating means comprise socket-like spring contacts adapted to receive and electrically mate with conductive strips disposed on at least one side of a printed circuit card, and said cover includes means for engaging said printed circuit card to maintain said electrical mating.

7. The arrangement of claim 1 wherein a predetermined electrical capacitance proportional to the thickness and composition of said dielectric means, is formed between adjacent terminals.

8. An electrical connector assembly having a plurality of terminals including means for mounting to a printed circuit board, contact means for electrical contact with a mating electrical member, means for insulating said terminals from each other, and means for supporting said plurality of terminals in a predetermined array, the improvement wherein:

said insulating means comprises a dielectric coating on at least one of said terminal in each pair of adjacent terminals; and said terminals are contiguous and arranged in a unitary free standing stacked array, whereby pairs of adjacent terminals provide mutual support when said terminals are mounted in a printed circuit board.

* * * * *